United States Patent [19]

Fukumoto

[11] Patent Number: 4,580,822

[45] Date of Patent: Apr. 8, 1986

[54] DOOR HANDLE FOR A VEHICLE

[75] Inventor: Ryoichi Fukumoto, Nagoya, Japan

[73] Assignee: Aisin Seiki Kabushiki Kaisha, Japan

[21] Appl. No.: 566,424

[22] Filed: Dec. 28, 1983

[30] Foreign Application Priority Data

Dec. 30, 1982 [JP] Japan ..... 57-233163

[51] Int. Cl.[4] ..... E05B 3/00

[52] U.S. Cl. ..... 292/336.3; 292/348; 292/DIG. 31; 292/DIG. 38; 292/DIG. 53; 292/DIG. 64; 16/114 R; 16/266; 16/267; 16/DIG. 24

[58] Field of Search ..... 292/336.3, DIG. 31, 292/DIG. 53, DIG. 64, 348, DIG. 38, 113; 70/207, 208; 16/114 R, 266, 267, 112, DIG. 24

[56] References Cited

U.S. PATENT DOCUMENTS

| | | | |
|---|---|---|---|
| 2,236,391 | 3/1941 | Zabel | 292/DIG. 31 |
| 2,861,834 | 11/1958 | Allen | 292/336.3 |
| 3,283,549 | 11/1966 | Mees | 70/208 |
| 3,743,336 | 7/1973 | Andrews . | |
| 3,785,686 | 1/1974 | Armstrong | 292/336.3 |
| 3,795,416 | 3/1974 | Hehl et al. | 292/336.3 |
| 3,797,870 | 3/1974 | Beckman | 70/208 X |
| 4,038,718 | 8/1977 | Reilhac et al. | 292/336.3 X |

FOREIGN PATENT DOCUMENTS

| | | | |
|---|---|---|---|
| 809101 | 3/1969 | Canada | 292/336.3 |
| 2824216 | 12/1979 | Fed. Rep. of Germany | 292/337 |
| 0022997 | 2/1949 | Finland | 16/267 |
| 0639837 | 5/1962 | Italy | 16/267 |

*Primary Examiner*—Kenneth J. Dorner
*Assistant Examiner*—Lloyd A. Gall
*Attorney, Agent, or Firm*—Finnegan, Henderson, Farabow, Garrett & Dunner

[57] ABSTRACT

An internal door handle assembly for operating a locking mechanism. The handle is assembled into a casing so that projections on either the handle or the casing fit into grooves in the other. A torsion spring biases the handle to its closed position. A lever arm of the handle is secured by a pin to a rod that operates the locking mechanism. Once assembled, the rotational angle of the handle is limited by abutting the casing.

4 Claims, 11 Drawing Figures

DOOR HANDLE FOR A VEHICLE

BACKGROUND OF THE INVENTION

1. Field of the Invention

The present invention relates to a door handle assembly for a vehicle and, more particularly, to a door handle assembly for use on the inside surface of a vehicle door to operate a locking mechanism therefor.

2. Description of the Prior Art

Referring to FIGS. 1 to 3, a conventional inside door handle includes a casing 1 and a handle 2. The handle 2 is supported by a pivot pin 3 on the casing 1 and is rotatable in the direction of arrow a. The casing 1 is fixed on the inner side of an inside panel A of a door and supported by a door trim C. The handle 2 has an actuator 2*a* and a lever arm 2*b* extending beyond the pivot pin 3. The arm 2*b* is connected to an elongated member, such as a rod 4, so as to operate a door locking mechanism (not shown) by movement of the rod 4. The handle 2 and a cover portion 1*c* of the casing 1 are exposed to the inside of the vehicle.

The pivot pin 3 is required to be positioned as closely as possible to the inside of the vehicle, so that the distance b between the outer surface of the casing 1 and the inner surface of the door trim C is minimized. The handle assembly is a source of concern in a traffic accident involving a side or oblique impact, since if a passenger is thrown into the door trim C in the direction of arrow D, the trim may be bent. Then the rod 4 may be bent through the panel A, as shown by the chain line (in FIG. 1). As a result, the end portion e of the rod 4 connected to the locking mechanism (not shown) may be pulled in the same direction as when the handle 2 is operated to open the door. When the end portion e of the rod 4 is moved to the point g beyond the point f, as shown in FIG. 1, the door is unlocked and the door can be thrown open. For this reason, there must be at least a distance between point e and point f on the rod 4 so that if the rod moves between these points, the door will not be unlocked. This distance should be increased as far as possible to ensure safety.

This safety factor can be achieved by increasing the distance between the pivot pin 3 and the end h of the rod 4 pivoted in the arm 2*b* so as to increase the rotational sweep, i.e. the moment length, of the arm. However, since the door trim C is positioned as closely as possible to the inside panel A so as to increase the width of the passenger area of the vehicle, it is not feasible to extend the head of the arm 2*b* towards the inside panel A. Accordingly, the pivot pin 3 must be shifted inward towards the passenger area. Where the pivot pin 3 is shifted inward, however, a recess 1*a*, formed on the casing 1 to receive the pivot pin 3, is exposed in the passenger area. The external appearance then is undesirable. Further, the pivot pin 3 is in danger of coming out of the recess 1*a*.

Alternatively, an increase in the play distance of the rod 4 can be realized by increasing the rotational sweep of the handle 2. However, it then becomes troublesome to operate the handle 2.

SUMMARY OF THE INVENTION

One object of the present invention, therefore, is to provide an improved door handle assembly having a good appearance.

Another object of the present invention is to provide an improved door handle assembly which is easy to assemble.

A further object of the present invention is to improve the pivoting of the handle within the casing.

Still another object of the present invention is to provide a door handle assembly in which a recess for a pivot pin is not exposed in the passenger compartment of the vehicle.

Additional objects and advantages of the invention will be set forth in the description which follows, and in part will be obvious from the description, or may be learned by the practice of the invention. The objects and advantages of the invention may be realized and attained by means of the instrumentalities and combinations particularly pointed out in the appended claims.

To achieve the foregoing objects, there is provided by this invention an internal door handle assembly for disposition in a vehicle door to operate a locking mechanism by means of an elongated member connected thereto, comprising a casing for mounting in a substantially planar portion of the door, a handle having a lever arm for connection to the elongated member for operating the locking mechanism, ball and socket joint means having one degree of freedom for rotatably mounting the handle in the casing between the locked and unlocked positions, said ball and socket joint means including a pair of opposed, inwardly directed projections on the casing and a pair of grooves in the handle adjacent the sides thereof, said grooves and projections having complementary flat sides and complementary curved surfaces for permitting said flat sides of said grooves to be inserted along said flat sides of said projections for interconnecting said handle and said casing and wherein the rotation of said handle on said projections separates the flat sides of said grooves from the flat sides of said projections and locks said projections into said grooves; the planes of said flat sides of said projections being substantially perpendicular to the planar portion of the door, the insertion position of said handle being only while said handle is substantially perpendicular to said planar position of the door and wherein the unlocking arc of rotation of said handle is less than 90°; means for limiting the arc of movement of, said handle between the locked and unlocked positions, including an abutment on said casing for limiting the rotational movement of said lever arm; and means for pivotally interconnecting said lever arm to said elongated member and wherein said interconnecting means interacts with said abutment to limit the movement of said lever arm to prevent rotation of said handle to the insertion position.

The accompanying drawings which are incorporated in and constitute a part of this specification, illustrate one embodiment of the invention and, together with the description, serve to explain the principles of the invention.

DESCRIPTION OF THE PREFERRED EMBODIMENT

Figure 1:
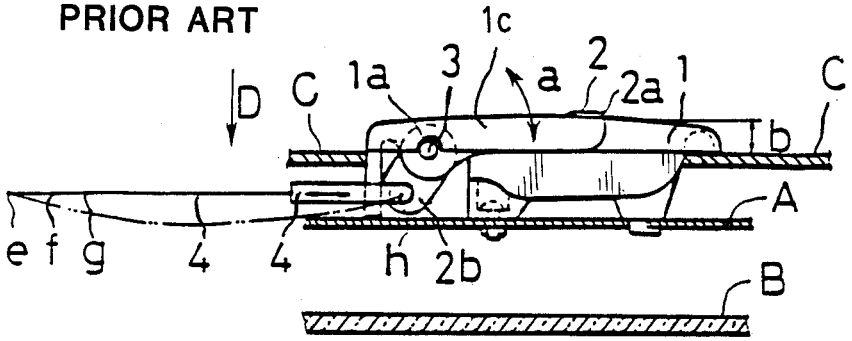
FIG. 1 PRIOR ART
FIG. 1 is a side view, partly in section, of a conventional door handle assembly for a vehicle.
Figure 2:
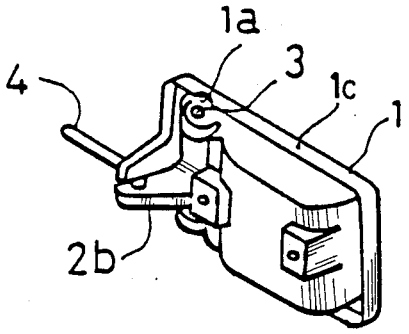
FIG. 2 PRIOR ART
FIG. 2 is a perspective view of the door handle assembly of FIG. 1.
Figure 3:
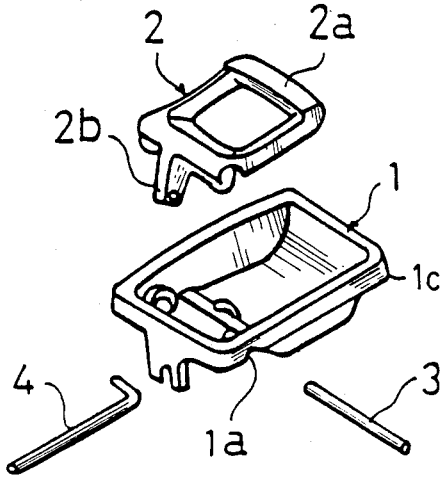
FIG. 3 PRIOR ART
FIG. 3 is an exploded perspective view of the door handle assembly of FIG. 1.
Figure 4:
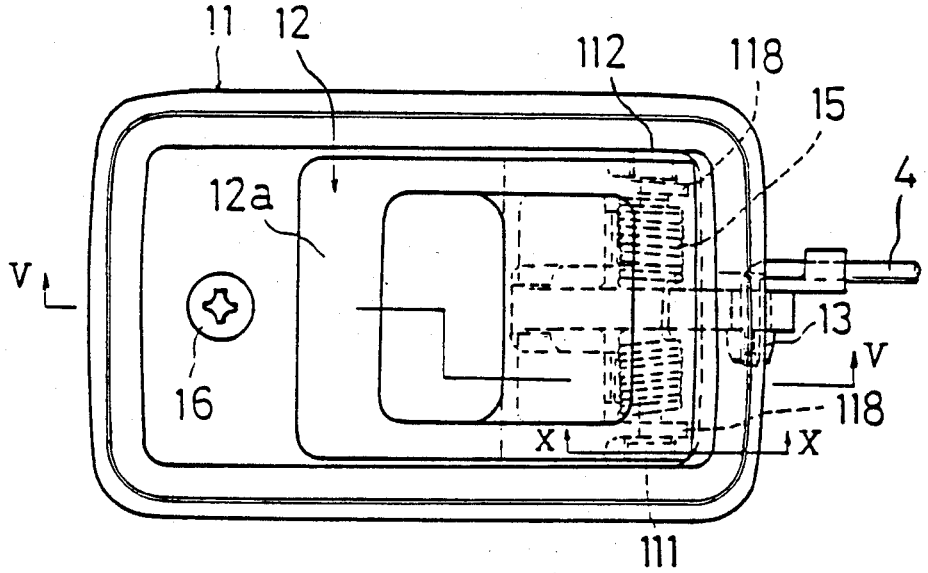
FIG. 4 is a plan view of the preferred embodiment of the door handle assembly constructed in accordance with the present invention.
Figure 5:
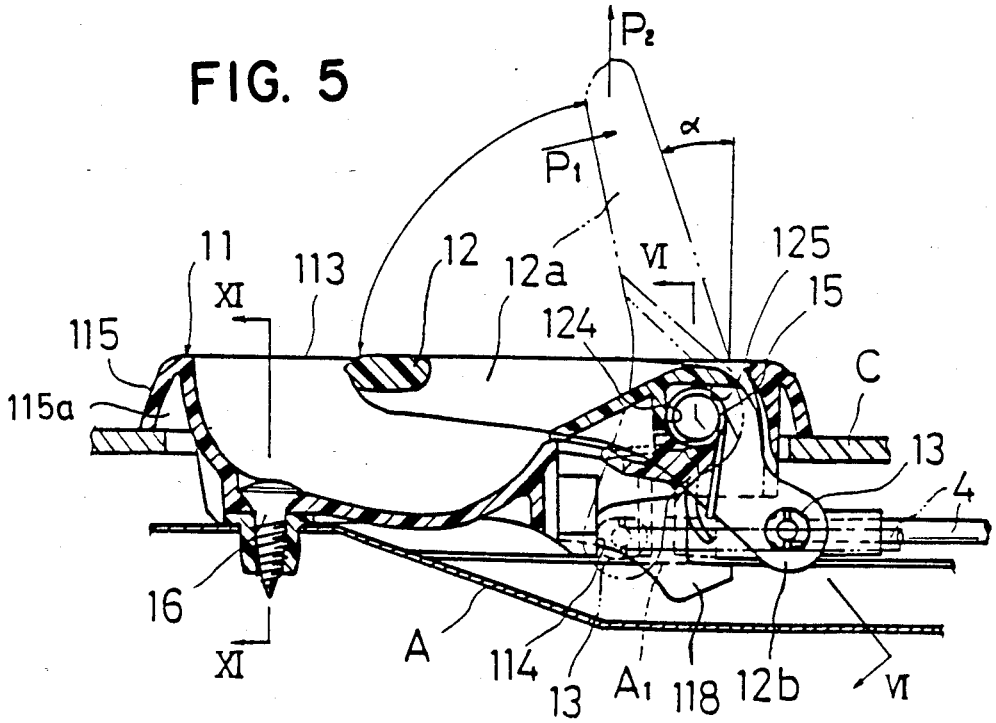
FIG. 5 is a cross-sectional view taken along line V—V of FIG. 4.

Referring to FIG. 4 and FIG. 5, a casing 11 is secured on an inside panel A of a vehicle door and a handle 12 is housed in and rotatably supported in the casing 11. The handle 12 is rotatable between a locked position, drawn by solid lines, and an unlocked position, drawn by chain lines, around a pair of projections 111 and 112 on the inner surface of casing 11. The handle 12 has an actuator 12*a* for grasping and an arm 12*b*, the arm 12*b* being rotatably connected to one end of a rod 4 through a clip 13, preferably made of resin.

Figure 7:
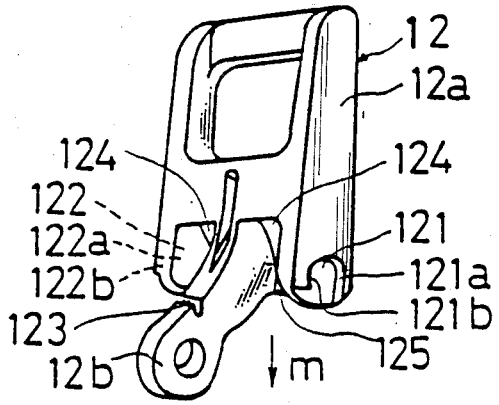
FIGS. 7 and 8 are partial perspective views of the preferred embodiment of FIG. 4.
Figure 8:
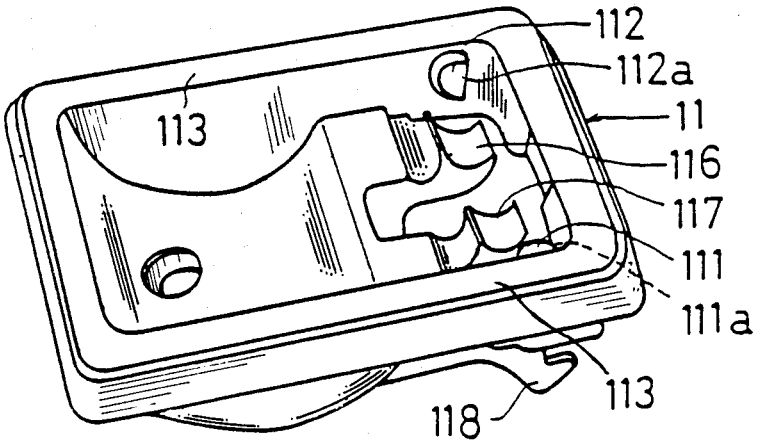

The pair of projections 111 and 112 are respectively engaged with a pair of grooves 121 and 122 formed in the handle 12 (FIG. 7). Each projection 111 and 112 has a straight portion 111*a* and 112*a* respectively, substantially perpendicular, in projection, to the panel A of the door, as shown in FIG. 8. Also, each groove 121 and 122 has a straight portion 121*a* and 122*a*, respectively, along the longitudinal direction of the handle 12 and is open through the surface of the handle 12, so that each projection 111 and 112 can be inserted into a respective groove 121 and 122.

Figure 9:
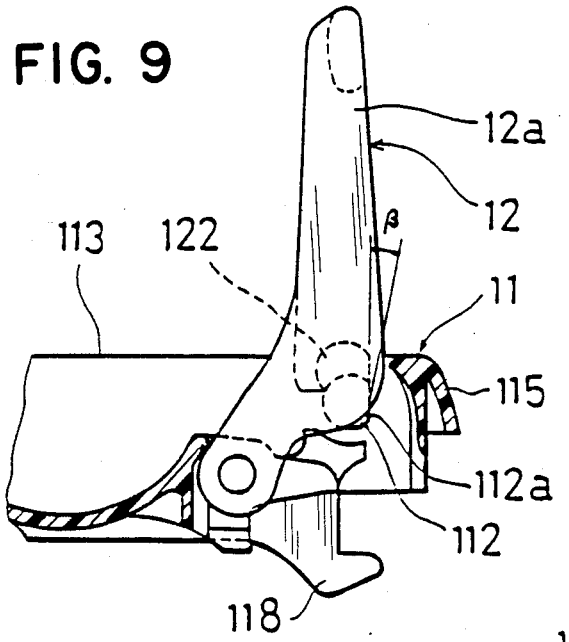
FIG. 9 is a partially assembled cross-sectional view of the door handle assembly of FIG. 4.

Assembly occurs by moving the handle in the direction of arrow m shown in FIG. 7. The straight portions 121*a* and 122*a* of the grooves 121 and 122 of the handle 12 slide along the straight portions 111*a* and 112*a* of the projections 111 and 112 of the casing 11, as shown in FIG. 9, and the projections 111 and 112 come into position at the circular portions 121*b* and 122*b* of the grooves 121 and 122. In this position, the handle 12 is rotatable around the projections 111 and 112.

At this point, as shown in FIG. 9, although the handle 12 has gone down at substantially a right angle to an outer surface 113 of the casing 11, the handle 12, in the final assembly, can only move to the unlocked position as shown in FIG. 5, where the handle 12 does not reach a position at a right angle to the outer surface 113 of the casing 11. This results from the fact that, after assembling the handle 12 and the casing 11, as described above, a clip 13 is secured to the arm 12*b*, so that the handle 12 cannot move back to the insert position. When the handle 12 is raised to the unlocked position of FIG. 5, the clip 13 is stopped against an abutment portion 114 on the casing 11. Therefore, after assembly, the handle 12 is supported in the casing 11 and cannot fall or be pulled off.

The unlocked position of the handle 12 is shifted from the insert position by an angle of $\alpha$ as shown in FIG. 5. Further, the straight portions 111*a* and 112*a* of the projections 111 and 112 may be formed at an angle of $\beta$, beyond the perpendicular from the unlocked position, as shown in FIG. 9. Accordingly, it is difficult for the handle 12 to come out of the casing 11.

Figure 6:
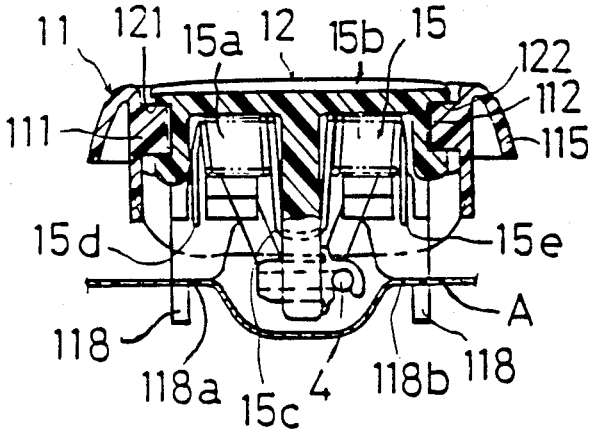
FIG. 6 is a cross-sectional view taken along line VI—VI of FIG. 5.

A torsion spring 15 is shaped symmetrically with a central U-shaped portion 15C shown in FIG. 6 and a pair of coil portions 15*a* and 15*b* extending from each end of the U-shaped portion. Both ends 15*d* and 15*e* of the spring 15 abut the casing 11 and the U-shaped portion 15C is engaged with a groove 123 of the arm 12*b* of the handle 12, so that the handle 12 is biased from the unlocked position to the locked position. If only a small biasing force is needed, only one of the coil portions 15*a* and 15*b* of the spring 15 may be required.

A cover portion 115 is integrally formed around the casing 11 in order to create a pleasant appearance. A groove 115*a* is provided between the cover portion 115 and the casing 11 for reducing the weight of the casing 11. Further, the casing 11 has a pair of arcuate support areas 116 and 117, as shown in FIG. 8, for supporting the torsion spring 15. The torsion spring 15 is also retained in position by the surfaces 124 and 125 of the handle 12 as shown in FIG. 5.

The handle 12 is assembled with the casing 11 as follows. First, the spring 15 is connected to the handle 12 by engaging the U-shaped portion 15*c* thereof with the groove 123 of the handle 12 and housing the coil spring portions 15*a* and 15*b* within the surfaces 124 and 125. Next, the projections 111 and 112 of the casing 11 are engaged with the grooves 121 and 122 of the handle 12 as described above. The clip 13 is then rotatably fixed in a hole in the arm 12*b* and one end of the rod 4 is engaged with a central hole of the clip 13. As shown in FIGS. 4–6, clip 13 is preferably formed with a pivot pin portion fixed in the hole or aperture of lever arm 12*b* and a socket portion for receiving the end of rod 4. Finally, the casing 11 is secured on the inside panel A by engaging a pair of hooks 118 with a pair of apertures A1 therein and tightening a male screw 16 through an aperture in the casing into the panel A.

Figure 10:
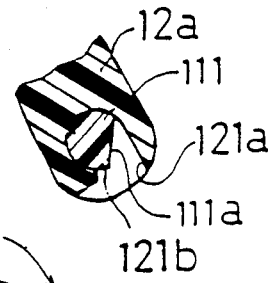
FIG. 10 is a partial cross-sectional view taken along line X—X of FIG. 4.

After assembly, even though force is applied to the handle 12 in the direction of arrow P1 toward the perpendicular position of the handle, the insert position, shown in FIG. 5, the handle 12 will not rotate beyond the unlocked position because the clip 13 will be against the abutment portion 114 of the casing 11. Moreover, even if further force is applied to the handle 12 in the direction of arrow P1, the casing 11 will not come away from the inside panel A because base portions 118*a* and 118*b* adjoining the hooks 118 (FIG. 6) are held firmly against the inside panel A. Also, even though force is applied to the handle 12 in the direction of arrow P2, tending to pull the handle out of the casing 11, as shown in FIG. 5, the handle 12 will not come away from the casing because the circular portions 121*b* and 122*b* of the grooves 121 and 122 of the handle 12 (FIG. 10) engage the projections 111 and 112.

Figure 11:
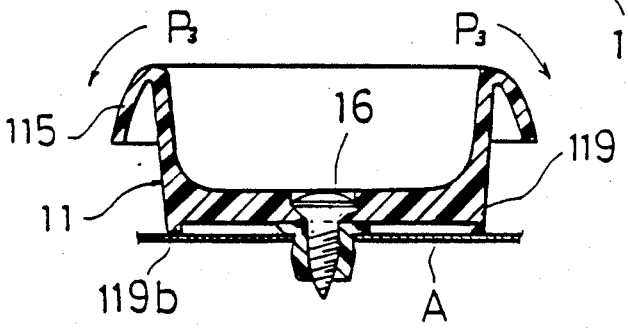
FIG. 11 is a cross-sectional view taken along line XI—XI of FIG. 5.

Moreover, even though force is applied to the handle 12 in the direction of arrow P3, tending to rock the casing 11 from side to side shown in FIG. 11, the casing 11 will not sink into the door trim C because base projections 119 and 119*b* of the casing 11 abut against the inside panel A. The projections 119 and 119*b* create a small gap between the rest of the lower surface of the casing 111 and the inside panel A.

According to the preferred embodiment of the present invention, instead of a pivot pin, a pair of projections 111 and 112 are integrally formed on the casing 11 and a pair of grooves 121 and 122 are integrally formed on the handle 12 so as to be engageable with the projections 111 and 112 in the state of rotation. Therefore, as the recess 1*a*, which is provided in the conventional handle, is not required, the appearance of the handle according to the invention will be pleasant. Also the construction and assembly of the handle will be easy.

It will be apparent to those skilled in the art that other modifications and variations can be made in the apparatus of this invention. The invention in its broader aspects is, therefore, not limited to the specific details, representative methods and apparatus, and illustrative examples shown and described. Accordingly, alterations may be made from such details without departing from the spirit and scope of the inventive concept.

What is claimed is:

1. An internal door handle assembly for disposition in a vehicle door to operate a locking mechanism by means of an elongated member connected thereto, said assembly comprising:

a casing for mounting in a substantially planar portion of the door;

a handle having a lever arm for connection to the elongated member for operating the locking mechanism;

ball and socket joint means having one degree of freedom for rotatably mounting said handle in said casing between locked and unlocked positions, said ball and socket joint means including:

a pair of opposed, inwardly directed projections on said casing and a pair of grooves in said handle adjacent the sides thereof;

said grooves and projections having complementary flat sides and complementary curved surfaces for permitting said flat sides of said grooves to be inserted along said flat sides of said projections for interconnecting said handle and said casing and wherein the rotation of said handle on said projections separates the flat sides of said grooves from the flat sides of said projections and locks said projections into said grooves;

the planes of said flat sides of said projections being substantially perpendicular to the planar portion of the door, the insertion position of said handle being only while said handle is substantially perpendicular to said planar portion of the door and wherein the unlocking arc of rotation of said handle is less than 90°;

means for limiting the arc of movement of said handle between the locked and unlocked positions, including:

an abutment on said casing for limiting the rotational movement of said lever arm; and means for pivotally interconnecting said lever arm to said elongated member and wherein said interconnecting means interacts with said abutment to limit the movement of said lever arm to prevent rotation of said handle to the insertion position.

2. The door handle assembly of claim 1 wherein said interconnecting means is a resin member having a pivot pin portion fitting into an aperture in said lever arm and a socket portion for receiving an end of said elongated member.

3. The door handle assembly of claim 1 further including means for biasing said handle into the locked position.

4. The door handle assembly of claim 3 wherein said biasing means includes a torsion spring having a central U-shaped portion acting against said lever arm and a symmetrical pair of coiled portions positioned between said lever arm and opposite sides of said casing.

* * * * *